US012077350B2

(12) United States Patent
Sollie et al.

(10) Patent No.: US 12,077,350 B2
(45) **Date of Patent: *Sep. 3, 2024**

(54) METHOD OF OPENING A BOX

(71) Applicant: Pratt Corrugated Holdings, Inc., Brookhaven, GA (US)

(72) Inventors: Greg Sollie, Sharpsburg, GA (US); Shifeng Chen, Newport News, VA (US); Randy Ball, Peachtree City, GA (US)

(73) Assignee: Pratt Corrugated Holdings, Inc., Brookhaven, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/233,745

(22) Filed: Aug. 14, 2023

(65) Prior Publication Data

US 2023/0382591 A1 Nov. 30, 2023

Related U.S. Application Data

(62) Division of application No. 17/726,093, filed on Apr. 21, 2022, now Pat. No. 11,794,942, which is a division of application No. 17/164,883, filed on Feb. 2, 2021, now Pat. No. 11,332,274, which is a division of application No. 16/568,714, filed on Sep. 12, 2019, now Pat. No. 10,981,692.

(51) Int. Cl.

| | |
|---|---|
| ***B65D 5/02*** | (2006.01) |
| ***B65D 5/42*** | (2006.01) |
| ***B65D 5/54*** | (2006.01) |

(52) U.S. Cl.

CPC ..... *B65D 5/0227* (2013.01); *B65D 5/4266* (2013.01); *B65D 5/54* (2013.01); *B65D 2543/00425* (2013.01)

(58) Field of Classification Search

CPC .. B65D 5/4279; B65D 5/0263; B65D 5/0262; B65D 5/068; B65D 5/064; B65D 5/541; B65D 5/54; B65D 5/4266; B65D 5/0227

USPC ..... 229/132, 138, 137, 140, 117, 103, 184, 229/222, 242

See application file for complete search history.

(56) References Cited

U.S. PATENT DOCUMENTS

| | | | |
|---|---|---|---|
| 2,692,721 | A | 10/1954 | Pennebaker et al. |
| 3,036,755 | A | 5/1962 | Stone |
| D196,883 | S | 11/1963 | Robinson |

(Continued)

FOREIGN PATENT DOCUMENTS

| | | |
|---|---|---|
| DE | 10136111 | 2/2003 |
| DE | 102012007800 | 10/2013 |
| EP | 3446996 | 2/2019 |

OTHER PUBLICATIONS

US 11,273,949 B2, 03/2022, Sollie et al. (withdrawn)

(Continued)

*Primary Examiner* — Christopher R Demeree

(74) *Attorney, Agent, or Firm* — Taylor English Duma LLP

(57) ABSTRACT

A method of opening a box includes providing the box in a closed configuration, the box comprising a first top panel attached to a second top panel, the first top panel comprising a first sealing flap, a second sealing flap, and a middle flap disposed therebetween; removing a first tear strip of the first sealing flap to detach the first sealing flap from the second top panel; and removing a second tear strip of the second sealing flap to detach the second sealing flap from the second top panel and to configure the box in an open configuration.

18 Claims, 14 Drawing Sheets

(56) References Cited

U.S. PATENT DOCUMENTS

| | | | |
|---|---|---|---|
| 3,206,101 | A | 9/1965 | Holmes |
| 3,206,102 | A | 9/1965 | Henry, Jr. et al. |
| 3,206,103 | A | 9/1965 | Bixler |
| 3,215,332 | A | 11/1965 | Bess |
| 3,229,890 | A | 1/1966 | Wright |
| 3,235,167 | A | 2/1966 | Svensson |
| 3,239,128 | A | 3/1966 | Rumberger |
| 3,263,899 | A | 8/1966 | Collura et al. |
| 3,295,741 | A | 1/1967 | Meyers |
| 3,306,521 | A | 2/1967 | Giacovas |
| D211,564 | S | 7/1968 | Balley |
| D212,683 | S | 11/1968 | Roccaforte et al. |
| D212,684 | S | 11/1968 | Roccaforte et al. |
| 3,438,566 | A | 4/1969 | Mahon |
| D214,879 | S | 8/1969 | Roccaforte et al. |
| D215,414 | S | 9/1969 | Roccaforte |
| 3,563,449 | A | 2/1971 | Forbes, Jr. |
| 3,661,321 | A | 5/1972 | Tessmer, Jr. |
| 3,669,345 | A | 6/1972 | Cote |
| 3,711,012 | A | 1/1973 | Cytron et al. |
| 3,758,023 | A | 9/1973 | Meyers |
| D232,081 | S | 7/1974 | Zine, Jr. |
| 3,833,165 | A | 9/1974 | Hoiles |
| 3,938,731 | A | 2/1976 | Ross et al. |
| 3,951,332 | A | 4/1976 | Torbeck |
| 3,971,503 | A | 7/1976 | Allan et al. |
| D243,663 | S | 3/1977 | Booth |
| D253,220 | S | 10/1979 | Roccaforte |
| 4,174,041 | A | 11/1979 | Turner |
| 4,180,167 | A | 12/1979 | Leavitt et al. |
| D255,994 | S | 7/1980 | Roccaforte |
| D256,437 | S | 8/1980 | Faller et al. |
| 4,230,261 | A | 10/1980 | Austin |
| D257,830 | S | 1/1981 | Card |
| D258,049 | S | 1/1981 | Bamburg et al. |
| D258,271 | S | 2/1981 | Booth et al. |
| D258,349 | S | 2/1981 | Booth et al. |
| 4,497,433 | A | 2/1985 | Wischusen, III |
| 4,535,928 | A | 8/1985 | Capo |
| D283,593 | S | 4/1986 | Hofer |
| 4,607,786 | A | 8/1986 | Weaver |
| D293,211 | S | 12/1987 | Depaul et al. |
| 4,752,028 | A | 6/1988 | Ogura |
| 4,819,807 | A | 4/1989 | Giger |
| 4,917,287 | A | 4/1990 | Watson |
| 4,944,405 | A | 7/1990 | Buford et al. |
| D310,633 | S | 9/1990 | Depaul et al. |
| D310,784 | S | 9/1990 | Forbes, Jr. |
| RE33,503 | E | 12/1990 | Schluger |
| 5,020,337 | A | 6/1991 | Kreig |
| 5,326,024 | A | 7/1994 | Fogle |
| 5,346,121 | A | 9/1994 | Beales |
| 5,497,876 | A | 3/1996 | Fleming |
| 5,503,328 | A | 4/1996 | Roccaforte et al. |
| D374,282 | S | 10/1996 | Hoftman |
| D394,606 | S | 5/1998 | Zorn et al. |
| D412,114 | S | 7/1999 | Hansen |
| 5,934,549 | A | 8/1999 | Baumgartner et al. |
| 5,934,550 | A | 8/1999 | Morris |
| D496,269 | S | 9/2004 | Hutchinson |
| D503,614 | S | 4/2005 | Sax et al. |
| 7,178,713 | B2 | 2/2007 | Stude |
| D601,419 | S | 10/2009 | Sant' Ana Caceres et al. |
| D603,258 | S | 11/2009 | Taketomi et al. |
| 7,743,944 | B2 | 6/2010 | Ho Fung et al. |
| 7,891,543 | B2 | 2/2011 | Abel et al. |
| 8,590,774 | B1 | 11/2013 | Sauer |
| D707,123 | S | 6/2014 | Marchetti et al. |
| 8,807,417 | B2 | 8/2014 | Valesini Gegembauer |
| 9,061,477 | B2 | 6/2015 | Chandaria |
| 9,714,112 | B1 | 7/2017 | Lin |
| D828,763 | S | 9/2018 | Tan |
| 10,099,807 | B2 | 10/2018 | Eisen et al. |
| 10,099,853 | B2 | 10/2018 | Miller |
| D840,219 | S | 2/2019 | Mckenna et al. |
| 10,279,950 | B2 | 5/2019 | Chang |
| 10,358,254 | B2 | 7/2019 | Buss |
| 10,435,194 | B2 | 10/2019 | Sollie et al. |
| 10,472,120 | B2 | 11/2019 | Cooper et al. |
| 10,479,547 | B2 | 11/2019 | Sumitomo |
| D877,614 | S | 3/2020 | Sollie et al. |
| 10,618,684 | B2 | 4/2020 | Eckert et al. |
| 10,625,898 | B2 | 4/2020 | Hodge et al. |
| 10,640,254 | B2 | 5/2020 | Oostwouder |
| D887,265 | S | 6/2020 | Perella et al. |
| 10,683,130 | B2 | 6/2020 | Takeuchi |
| 10,723,496 | B2 | 7/2020 | Riswick et al. |
| 10,723,505 | B2 | 7/2020 | Lopez Masague |
| D891,919 | S | 8/2020 | Sill et al. |
| 10,766,661 | B2 | 9/2020 | Perella et al. |
| D898,566 | S | 10/2020 | Hughes et al. |
| D911,164 | S | 2/2021 | Barker |
| 10,981,692 | B2 | 4/2021 | Sollie et al. |
| D919,432 | S | 5/2021 | Muse et al. |
| 11,059,652 | B2 | 7/2021 | Sollie et al. |
| D926,568 | S | 8/2021 | Natsume et al. |
| 11,230,404 | B2 | 1/2022 | Sollie et al. |
| D942,853 | S | 2/2022 | Sollie et al. |
| D943,412 | S | 2/2022 | Mayer |
| D946,768 | S | 3/2022 | Kemper et al. |
| 11,312,526 | B2 | 4/2022 | Sollie et al. |
| 11,332,274 | B2 | 5/2022 | Sollie et al. |
| D968,950 | S | 11/2022 | Sollie et al. |
| D977,967 | S | 2/2023 | Sollie et al. |
| D977,968 | S | 2/2023 | Sollie et al. |
| D981,847 | S | 3/2023 | Riffe et al. |
| 11,623,785 | B2 | 4/2023 | Walters et al. |
| D988,862 | S | 6/2023 | Turner |
| 11,794,942 | B2 | 10/2023 | Sollie et al. |
| D1,032,358 | S | 6/2024 | Walters et al. |
| 2003/0201315 | A1 | 10/2003 | Jamison et al. |
| 2005/0145683 | A1 | 7/2005 | Alagna et al. |
| 2006/0118605 | A1 | 6/2006 | Justice et al. |
| 2008/0083822 | A1 | 4/2008 | Benes |
| 2008/0296360 | A1 | 12/2008 | Abel et al. |
| 2009/0200324 | A1 | 8/2009 | Geelen |
| 2010/0065620 | A1 | 3/2010 | Smith |
| 2010/0327048 | A1 | 12/2010 | Tsai |
| 2011/0056975 | A1 | 3/2011 | Mcgillion |
| 2011/0117258 | A1 | 5/2011 | Burke |
| 2016/0122069 | A1 | 5/2016 | Eisen et al. |
| 2016/0137335 | A1 | 5/2016 | Mora |
| 2016/0318654 | A1 | 11/2016 | Ayerst et al. |
| 2017/0267395 | A1 | 9/2017 | Kansburg |
| 2017/0341802 | A1 | 11/2017 | Sumitomo |
| 2018/0105313 | A1 | 4/2018 | Buss |
| 2018/0170610 | A1 | 6/2018 | Buss |
| 2018/0215499 | A1 | 8/2018 | Imai et al. |
| 2018/0354674 | A1 | 12/2018 | Hodge et al. |
| 2019/0077539 | A1 | 3/2019 | Sollie et al. |
| 2020/0148452 | A1 | 5/2020 | Sollie et al. |
| 2020/0172317 | A1 | 6/2020 | Costanzo, Jr. |
| 2020/0239177 | A1 | 7/2020 | Gathercole et al. |
| 2021/0078755 | A1 | 3/2021 | Sollie et al. |
| 2021/0147109 | A1 | 5/2021 | Sollie et al. |
| 2021/0155365 | A1 | 5/2021 | Sollie et al. |
| 2021/0155367 | A1 | 5/2021 | Sollie et al. |
| 2021/0284382 | A1 | 9/2021 | Walters et al. |
| 2021/0347553 | A1 | 11/2021 | Sollie et al. |
| 2022/0242607 | A1 | 8/2022 | Sollie et al. |
| 2022/0332000 | A1 | 10/2022 | Foster et al. |
| 2023/0219712 | A1 | 7/2023 | Walters et al. |
| 2023/0382590 | A1 | 11/2023 | Sollie et al. |

OTHER PUBLICATIONS

Sollie, Greg; Corrected Notice of Allowance for U.S. Appl. No. 16/568,714, filed Sep. 12, 2019, mailed Mar. 15, 2021, 9 pgs.

Sollie, Greg; Final Office Action for U.S. Appl. No. 16/568,714, filed Sep. 12, 2019, mailed Nov. 2, 2020, 10 pgs.

Sollie, Greg; Non-Final Office Action for U.S. Appl. No. 16/568,714, filed Sep. 12, 2019, mailed Jun. 8, 2020, 17 pgs.

(56) References Cited

OTHER PUBLICATIONS

Sollie, Greg; Notice of Allowance for U.S. Appl. No. 16/568,714, filed Sep. 12, 2019, mailed Nov. 23, 2020, 5 pgs.
Sollie, Greg; Requirement for Restriction/Election for U.S. Appl. No. 16/568,714, filed Sep. 12, 2019, mailed May 18, 2020, 6 pgs.
Sollie, Greg; Non-Final Office Action for U.S. Appl. No. 17/163,832, filed Feb. 1, 2021, mailed Sep. 27, 2021, 22 pgs.
Sollie, Greg; Notice of Allowance for U.S. Appl. No. 17/163,832, filed Feb. 1, 2021, mailed Jan. 19, 2022, 10 pgs.
Sollie, Greg; Certificate of Correction for U.S. Appl. No. 17/164,883, filed Feb. 2, 2021, mailed Oct. 17, 2023, 1 pg.
Sollie, Greg; Non-Final Office Action for U.S. Appl. No. 17/164,883, filed Feb. 2, 2021, mailed Sep. 28, 2021, 19 pgs.
Sollie, Greg; Notice of Allowance for U.S. Appl. No. 17/164,883, filed Feb. 2, 2021, mailed Jan. 25, 2022, 10 pgs.
Sollie, Greg; Applicant-Initiated Interview Summary for U.S. Appl. No. 17/726,093, filed Apr. 21, 2022, mailed Dec. 30, 2022, 2 pgs.
Sollie, Greg; Non-Final Office Action for U.S. Appl. No. 17/726,093, filed Apr. 21, 2022, mailed Feb. 9, 2023, 24 pgs.
Sollie, Greg; Notice of Allowance for U.S. Appl. No. 17/726,093, filed Apr. 21, 2022, mailed May 23, 2023, 13 pgs.
Sollie, Greg; Requirement for Restriction/Election for U.S. Appl. No. 17/726,093, filed Apr. 21, 2022, mailed Nov. 10, 2022, 6 pgs.
DAVPACK; Article entitled: "ColomPac Premium Instant Base Boxes", located at https://www.davpack.co.uk/postal-packaging/postal-boxes/instant-base-boxes.htm>, accessed on Feb. 14, 2020, 1 pg.
Walters, Travis; Applicant-Initiated Interview Summary for U.S. Appl. No. 16/818,144, filed Mar. 13, 2020, mailed Feb. 16, 2022, 2 pgs.
Walters, Travis; Certificate of Correction for U.S. Appl. No. 16/818,144, filed Mar. 13, 2020, mailed Jun. 27, 2023, 1 pg.
Walters, Travis; Non-Final Office Action for U.S. Appl. No. 16/818,144, filed Mar. 13, 2020, mailed Nov. 16, 2021, 31 pgs.
Walters, Travis; Non-Final Office Action for U.S. Appl. No. 16/818,144, filed Mar. 13, 2020, mailed May 26, 2022, 16 pgs.
Walters, Travis; Notice of Allowance for U.S. Appl. No. 16/818,144, filed Mar. 13, 2020, mailed Dec. 1, 2022, 18 pgs.
Youtube; Images of video for ColomPac CP 155 Premium quick base box, located at <https://www.youtube.com/watch?v=oqw-fGczpS8>, published on Jul. 30, 2015, 7 pgs.
Walters, Travis; Non-Final Office Action for U.S. Appl. No. 18/114,762, filed Feb. 27, 2023, mailed Jun. 13, 2023, 33 pgs.
Sollie, Greg; Corrected Notice of Allowance for Design U.S. Appl. No. 29/705,472, filed Sep. 12, 2019, mailed Jun. 17, 2021, 5 pgs.
Sollie, Greg; Non-Final Office Action for Design U.S. Appl. No. 29/705,472, filed Sep. 12, 2019, mailed Feb. 3, 2021, 31 pgs.
Sollie, Greg; Notice of Allowance for Design U.S. Appl. No. 29/705,472, filed Sep. 12, 2019, mailed May 17, 2021, 8 pgs.
Sollie, Greg; Non-Final Office Action for Design U.S. Appl. No. 29/804,166, filed Aug. 18, 2021, mailed Jun. 6, 2022, 33 pgs.
Sollie, Greg; Notice of Allowance for Design U.S. Appl. No. 29/804,166, filed Aug. 18, 2021, mailed Nov. 23, 2022, 17 pgs.
Sollie, Greg; Non-Final Office Action for Design U.S. Appl. No. 29/804,168, filed Aug. 18, 2021, mailed Jun. 6, 2022, 33 pgs.
Sollie, Greg; Notice of Allowance for Design U.S. Appl. No. 29/804,168, filed Aug. 18, 2021, mailed Nov. 23, 2022, 16 pgs.
Dual Use Boxes: Announced (Aug. 17, 2020 (online). Site Visited (Apr. 22, 2023). Available from URL: https://link.usps.com/2020/08/17 /dual-use-boxes/.
Folding Carton: Site Visited (Apr. 22, 2023). Available from URL: https://www.verpacking.com/en/Folding-carton-1-wall310x230x210-din-a4-mm-self-adhesive-return-closure-progressBOX.
Premium System Shipping Transport Carton with SuperFlap: Site Visited (Apr. 22, 2023). Available from URL: https://.www.progress-packaging.com/en/products/transport-system-packaging/premium-system-shipping-transport-carton-with-superflap.html.
Walters, Travis; Ex Parte Quayle Action for Design U.S. Appl. No. 29/727,831, filed Mar. 13, 2020, mailed May 10, 2023, 66 pgs.
Walters, Travis; Notice of Allowance for Design U.S. Appl. No. 29/727,831, filed Mar. 13, 2020, mailed Sep. 27, 2023, 14 pg.
DAVPACK; Images of ColomPac Premium Instant Base Boxes, publicly available prior to Feb. 12, 2020, 5 pgs.
Blake Purely Packaging: Announced [Apr. 15, 2014]. Site Visited [May 31, 2022]. Available from Internet URL: https://w.amazon.com/Purely-Packaging-PS B500-300x190x40mm-Evident/dp/B00HXB H 9RQ?th = 1, 13 pgs.
Tamper Proof Packaging: Announced [Aug. 14, 2020]. Available from Internet URL: https://www.gwp.co.uk/packaging/ecommerce/tamper-proof/, 4 pgs.
Creative Cartons; Article entitled: "COLOMPAC® intelligent packaging—uniquely designed to save you time, materials and a lot of frustration", located at <https://www.pegasusmediasolutions.com/>, downloaded and publicly available on Mar. 15, 2019, 5 pgs.
Oct. 17, 2023, Sollie, Greg; Certificate of Correction for U.S. Appl. No. 17/164,883, filed Feb. 2, 2021, mailed Oct. 17, 2023, 1 pg.
Sep. 27, 2023, Walters, Travis; Notice of Allowance for Design U.S. Appl. No. 29/727,831, filed Mar. 13, 2020, mailed Sep. 27, 2023, 14 pg.
Nov. 10, 2022, Sollie, Greg; Requirement for Restriction/Election for U.S. Appl. No. 17/726,093, filed Apr. 21, 2022, mailed Nov. 10, 2022, 6 pgs.
Dec. 301, 2022, Sollie, Greg; Applicant-Initiated Interview Summary for U.S. Appl. No. 17/726,093, filed Apr. 21, 2022, mailed Dec. 30, 2022, 2 pgs.
Feb. 9, 2023, Sollie, Greg; Non-Final Office Action for U.S. Appl. No. 17/726,093, filed Apr. 21, 2022, mailed Feb. 9, 2023, 24 pgs.
May 23, 2023, Sollie, Greg; Notice of Allowance for U.S. Appl. No. 17/726,093, filed Apr. 21, 2022, mailed May 23, 2023, 13 pgs.
Sollie, Greg; Certificate of Correction for U.S. Appl. No. 17/726,093, filed Apr. 21, 2022, mailed Dec. 19, 2023, 1 pg.
Walters, Travis; Non-Final Office Action for U.S. Appl. No. 18/114,762, filed Feb. 27, 2023, mailed Dec. 20, 2023, 17 pgs.
alibaba.com; Article entitled: "Custom corrugated carton boxes tear strip tear line zipper self sealing mailer box with self adhesive shipping boxes", located at <https://www.alibaba.com/ product-detail/custom-corrugated-carton-boxes-tear-strip_ 1600104791034.html>, accessed on Jan. 24, 2024, 12 pgs.
Custom Corrugated Packaging Box with Tear Strip: Announced (Dec. 8, 2022; online). Site Visited (Jan. 24, 2024). Available from URL: https://www.giftpackagingbox.com/corrugated-packaging-box-with-tear-strip.html, 4 pgs.
System-Versand-Transportkarton: Announced (Sep. 20, 2020; online). Site Visited (Jan. 24, 2024). Available from URL: https: //www.packster.de/p/syste m-versand-transportkarton-premium-superflap/B0003276/#ite mId= A0003278, 3 pgs.
Walters, Travis; Ex Parte Quayle Action for U.S. Appl. No. 29/921,125, filed Dec. 14, 2023, mailed Jan. 30, 2024, 8 pgs.
Sollie, Greg; Non-Final Office Action for U.S. Appl. No. 18/233,743, filed Aug. 14, 2023, mailed Apr. 15, 2024, 33 pgs.
Sollie, Greg; Requirement for Restriction/Election for U.S. Appl. No. 18/233,743, filed Aug. 14, 2023, mailed Apr. 2, 2024, 6 pgs.
Walters, Travis; Applicant-Initiated Interview Summary for U.S. Appl. No. 18/114,762, filed Feb. 27, 2023, mailed Mar. 14, 2024, 2 pgs.
Walters, Travis; Notice of Allowance for Design U.S. Appl. No. 29/727,831, filed Mar. 13, 2020, mailed Apr. 8, 2024, 15 pgs.
Walters, Travis; Notice of Allowance for Design U.S. Appl. No. 29/921,125, filed Dec. 14, 2023, mailed Apr. 23, 2024, 26 pgs.

METHOD OF OPENING A BOX

CROSS-REFERENCE TO RELATED APPLICATIONS

The present application is a divisional of U.S. application Ser. No. 17/726,093, filed Apr. 21, 2022, which is a continuation of U.S. application Ser. No. 17/164,883, filed Feb. 2, 2021, which issued as U.S. Pat. No. 11,332,274 on May 17, 2022, which is a divisional of U.S. application Ser. No. 16/568,714, filed Sep. 12, 2019, which issued as U.S. Pat. No. 10,981,692 on Apr. 20, 2021, all of which are hereby specifically incorporated by reference herein in their entireties.

TECHNICAL FIELD

This disclosure relates to packaging. More specifically, this disclosure relates to a dual use box.

BACKGROUND

Buying items online often involves returning said items. Repacking items to return can involve the hassle of keeping the box in which the items arrived, and re-taping the box in preparation for mailing it back. Some people may not have packaging tape available, requiring an additional purchase just to return the item. Damage may also occur to the box during the initial unpacking, rendering the box unsuitable for shipping.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

Disclosed is a box comprising: a side panel; a covering top panel connected to the side panel by a fold line, the covering top panel comprising an overlapping portion comprising: a primary sealing flap, the primary sealing flap comprising a primary adhesive; a secondary flap connected to the primary sealing flap by a perforated line, the secondary flap comprising a distal end and a proximal portion that is proximal the side panel relative to the distal end, the distal end comprising a secondary adhesive, the distal end joined to the proximal portion by a tear strip.

Also disclosed is a collapsible box comprising a box bottom comprising: a first bottom panel; a second bottom panel adjacent to the first bottom panel, the second bottom panel attached to the first bottom panel; a third bottom panel adjacent to the second bottom panel, the third bottom panel unattached to the second bottom panel; and a fourth bottom panel adjacent to the third bottom panel, the fourth bottom panel attached to the third bottom panel and unattached to the first bottom panel.

Also disclosed is a method of using a box comprising a primary sealing flap comprising a primary adhesive, a secondary flap connected to the primary sealing flap and comprising a secondary adhesive, and a covered top panel opposite the secondary flap, the method comprising: removing a secondary peelable backing from the secondary adhesive; leaving a primary peelable backing adhered to the primary adhesive; and adhering the secondary flap to the covered top panel with the secondary adhesive.

Disclosed is a method of using a box comprising a primary sealing flap comprising a primary adhesive, a secondary flap connected to the primary sealing flap and comprising a secondary adhesive, and a covered top panel opposite the secondary flap, the method comprising: removing a secondary peelable backing from the secondary adhesive; leaving a primary peelable backing adhered to the primary adhesive; and adhering the secondary flap to the covered top panel with the secondary adhesive.

Another method of using a box is disclosed, the method comprising orienting the box in a first open configuration, the box comprising a first top panel and a second top panel, the first top panel comprising a primary sealing flap comprising a primary adhesive and a secondary sealing flap comprising a secondary adhesive; sealing the box in a first closed configuration by adhering the secondary sealing flap to the second top panel with the secondary adhesive; orienting the box in a second open configuration; and sealing the box in a second closed configuration by adhering the primary sealing flap to the second top panel with the primary adhesive.

A method of opening a box is disclosed, the method comprising providing the box in a closed configuration, the box comprising a first top panel attached to a second top panel, the first top panel comprising a first sealing flap, a second sealing flap, and a middle flap disposed therebetween; removing a first tear strip of the first sealing flap to detach the first sealing flap from the second top panel; and removing a second tear strip of the second sealing flap to detach the second sealing flap from the second top panel and to configure the box in an open configuration.

Additionally, a method of using a box is disclosed, the method comprising sealing the box is a first closed configuration, which comprises coupling a first top panel of the box to a second top panel of the box with a first fastener; removing a first tear strip of the first top panel to configure the box in a first open configuration; and sealing the box in a second closed configuration, which comprises coupling the first top panel to the second top panel with a second fastener.

Also disclosed is a method of assembling a box from a box blank, the method comprising providing the box blank comprising a plurality of sidewalls, a first top panel extending from a first sidewall of the plurality of sidewalls, and a second top panel extending from a second sidewall of the plurality of sidewalls, wherein the plurality of sidewalls, the first top panel, and the second top panel are substantially coplanar, the first top panel comprising a first fastener and a first tear strip; folding the plurality of sidewalls to at least partially enclose an interior cavity of the box; folding the second top panel relative to the second sidewall to at least partially cover an opening of the interior cavity; folding the first top panel relative to the first sidewall to cover the opening; and attaching the first top panel to the second top panel with the first fastener, wherein removing the first tear strip detaches the first top panel from the second top panel.

A box is also disclosed, the box comprising a plurality of side panels comprising a first side panel and a second side panel opposite the first side panel; a first top panel extending from the first side panel, the first top panel comprising a primary sealing flap and a secondary sealing flap; and a second top panel extending from the second side panel, the box configurable in a first closed configuration, wherein the secondary sealing flap is secured to the second top panel, and a second closed configuration, wherein the primary sealing flap is secured to the second top panel.

Furthermore, disclosed is a box blank comprising a plurality of coplanar side panels comprising a first side panel and a second side panel; a first top panel pivotably connected to and coplanar with the first side panel, the first top panel comprising a primary sealing flap and a secondary sealing flap; and a second top panel pivotably connected to and coplanar with the second side panel; wherein the box blank is foldable to form a box, and wherein the box is configurable in a first closed configuration, wherein the secondary sealing flap is secured to the second top panel, and a second closed configuration, wherein the primary sealing flap is secured to the second top panel.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The features and components of the following figures are illustrated to emphasize the general principles of the present disclosure. The drawings are not necessarily drawn to scale. Corresponding features and components throughout the figures may be designated by matching reference characters for the sake of consistency and clarity.

DETAILED DESCRIPTION

Figure 1A:
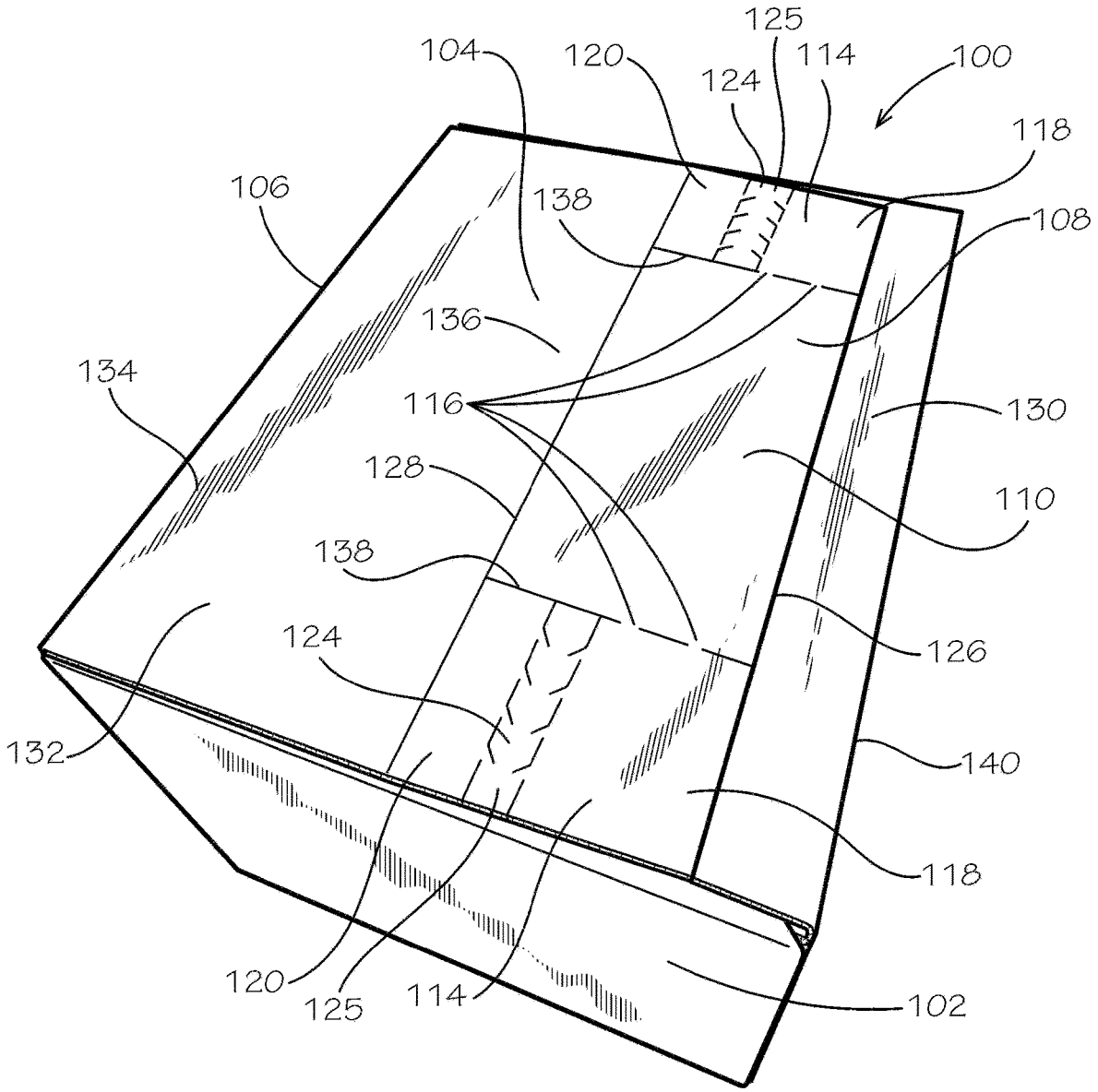
FIG. 1A is a perspective view of a dual use box, in accordance with one aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

The use of the directional terms herein, such as right, left, front, back, top, bottom, and the like can refer to the orientation shown and described in the corresponding figures, but these directional terms should not be considered limiting on the orientation or configuration required by the present disclosure. The use of ordinal terms herein, such as first, second, third, fourth, and the like can refer to elements associated with elements having matching ordinal numbers. For example, a first light bulb can be associated with a first light socket, a second light bulb can be associated with a second light socket, and so on. However, the use of matching ordinal numbers should not be considered limiting on the associations required by the present disclosure.

Disclosed is a dual use box and associated methods, systems, devices, and various apparatus. It would be understood by one of skill in the art that the box is described in but a few exemplary embodiments among many. No particular terminology or description should be considered limiting on the disclosure or the scope of any claims issuing therefrom.

Figure 9:
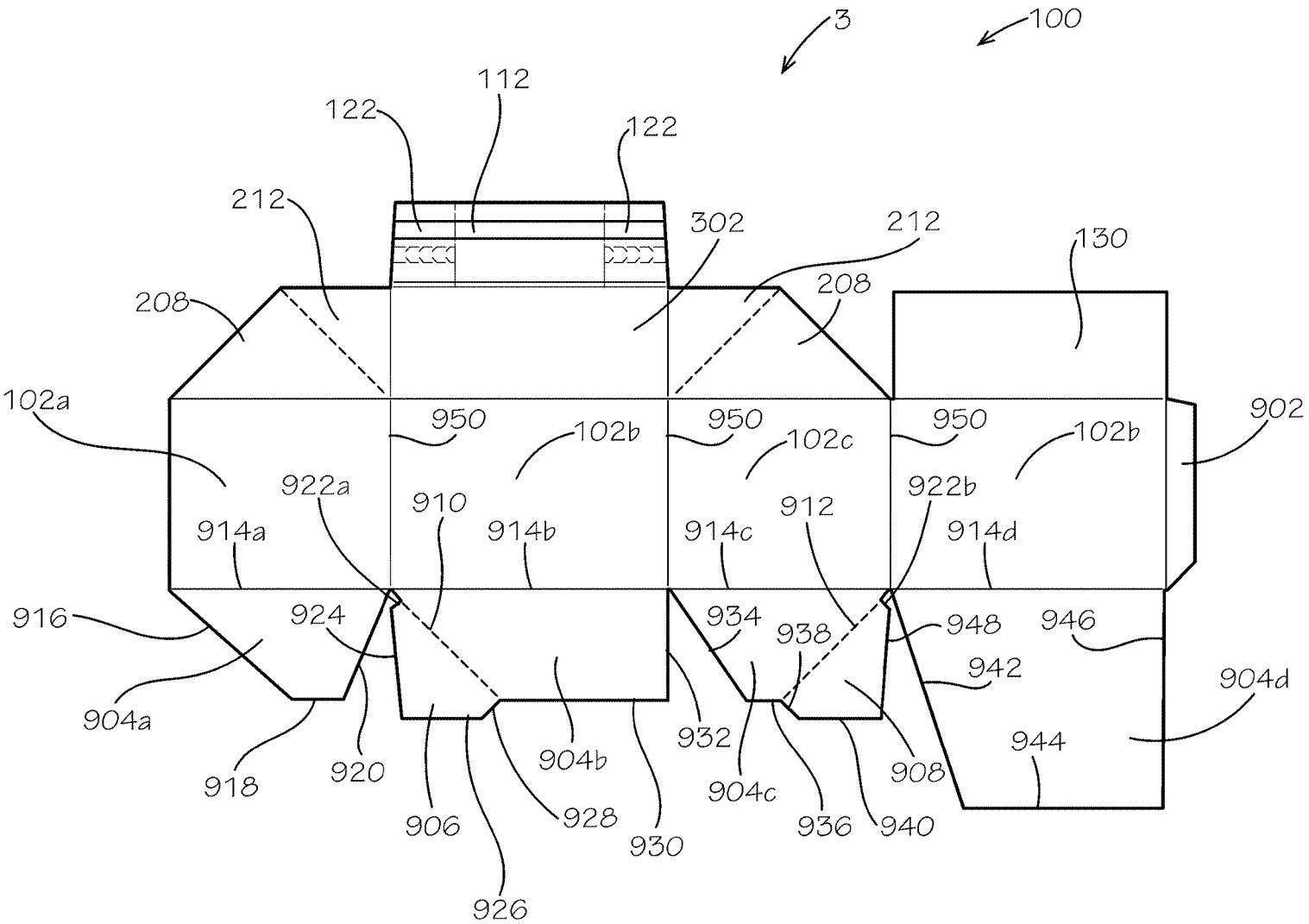
FIG. 9 is a plan view of a blank for the dual use box of FIG. 1A.

FIG. 1A is a perspective view of a dual use box 100, in accordance with one aspect of the present disclosure. The dual use box 100 can be configured to easily seal and be used twice. The box can comprise four side panels 102. Only one side panel 102 is shown in FIG. 1A. All four side panels 102 (in particular, a first, second, third, and fourth side panel 102*a,b,c,d*, respectively) can be seen in FIG. 2 and in FIG. 9, which shows a blank 3 of the box 100. A covering top panel 104 can be connected to one of the side panels 102 (in particular, the second side panel 102*b*, as shown in FIG. 9) by a covering top panel fold line 106. The covering top panel 104 can comprise an overlapping portion 108. The overlapping portion 108 can comprise a primary sealing flap 110, and the primary sealing flap 110 can comprise a primary adhesive 112, which can be seen in FIG. 2. In the aspect of FIG. 1A, the primary sealing flap 110 is positioned in a central location on the overlapping portion 108.

The overlapping portion 108 can also comprise a secondary flap 114, which can connect to the primary sealing flap 110 by a perforated line 116. In the aspect shown, the overlapping portion can comprise a pair of secondary flaps 114, which can each be positioned at one respective side of the overlapping portion and can be connected to each side of the primary sealing flap 110 by a pair of perforated lines 116. The perforated lines 116 can each be defined by a pair of short uncut segments between several flap cuts 138 between the primary sealing flap 110 and the secondary flap 114.

Each secondary flap 114 can comprise a distal end 118 and a proximal portion 120 that is proximal a connected side panel 102*b* (shown in FIG. 9), relative to the distal end 118. The distal end 118 of each secondary flap 114 can comprise a secondary adhesive 122 (shown in FIG. 2). The distal end 118 can be joined to the proximal portion 120 by a tear strip 124. The tear strip 124 can be defined by a cut pattern 124 configured to remove the tear strip 124 in one pull by a user at a pull end 125 of the tear strip 124.

The covering top panel 104 can further comprise a connecting portion 132, the connecting portion 132 comprising a side panel end 134 joined to the side panel 102*b* (shown in FIG. 9) by the covering top panel fold line 106. The connecting portion 132 can also comprise a connecting portion end 136 joined to the overlapping portion 108 by a top central fold line 128. The connecting-over fold line 128 can be a double fold line, the advantage of which is described in the discussion of FIG. 12.

The box 100 can further comprise a covered top panel 130. The covered top panel 130 can be subjacent to the covering top panel 104 in the assembled configuration. The covering top panel 104 can adhere to the covered top panel 130 by one or more of the primary adhesive 112 (shown in FIG. 2) and the secondary adhesive 122 (shown in FIG. 2). The adhesives 112,122 can be affixed to an interior face 302 (shown in FIG. 2) of the covering top panel 104 (or more generally, of the box blank 3).

The covering top panel 104 can define a top edge 126. In the assembled configuration, the top edge 126 in some aspects does not extend to a covered top panel fold line 140 between the side panel 102*d* (shown in FIG. 9) and the covered top panel 130.

Figure 1B:
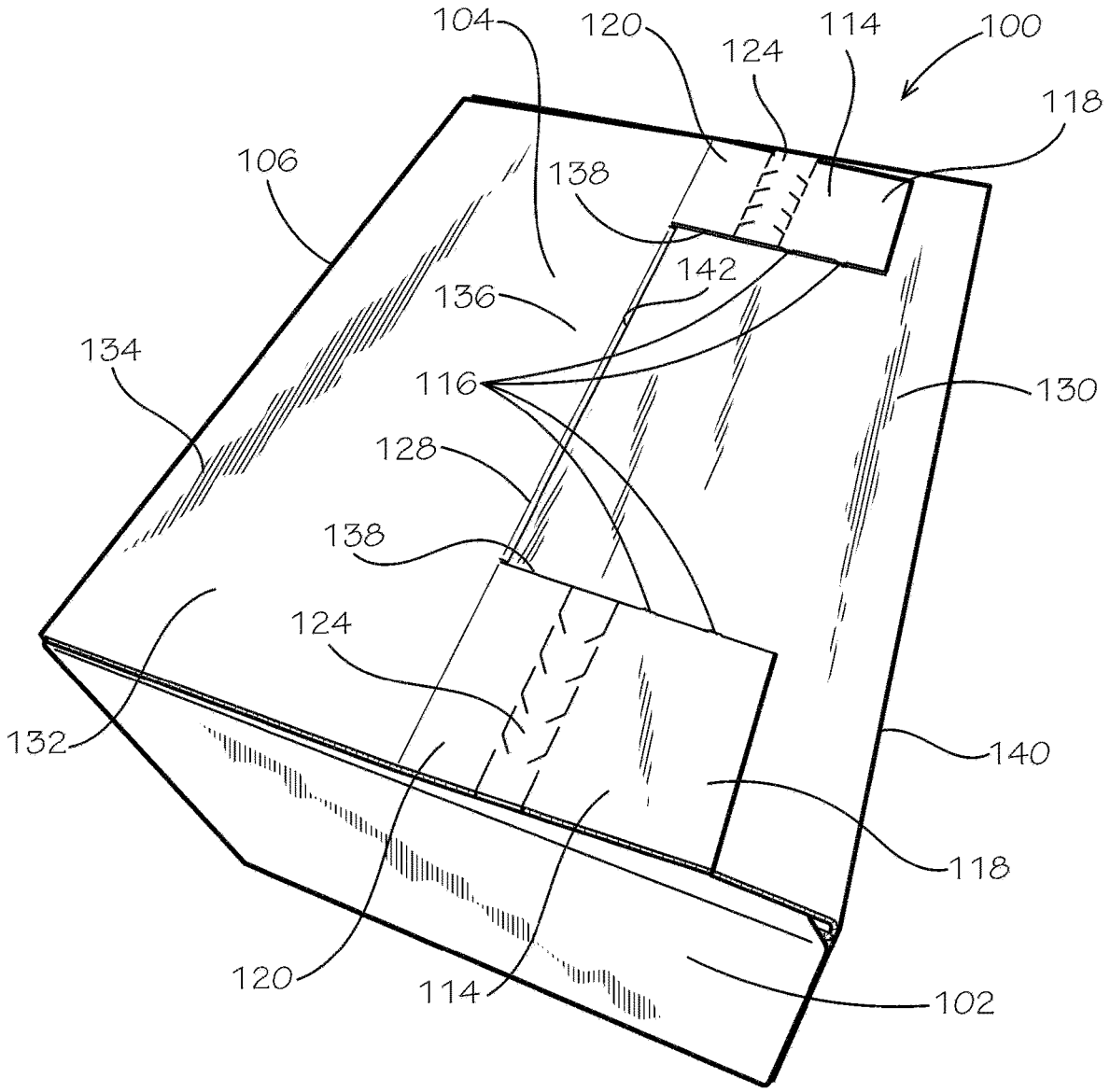
FIG. 1B is a perspective view of the dual use box, in accordance with another aspect of the present disclosure.

FIG. 1B is a perspective view of the dual use box 100, in accordance with another aspect of the present disclosure. When closing the box 100 towards this configuration (a step in closing the box in this aspect is shown in FIG. 4B), the perforated lines 116 can be undone, and the primary sealing flap 110 (shown in FIG. 1A) can tuck under the covered top panel 130. The covered top panel 130 can comprise a covered top panel edge 142, which in the current aspect can abut, or lay adjacent to, the connecting-over fold line 128.

Figure 2:
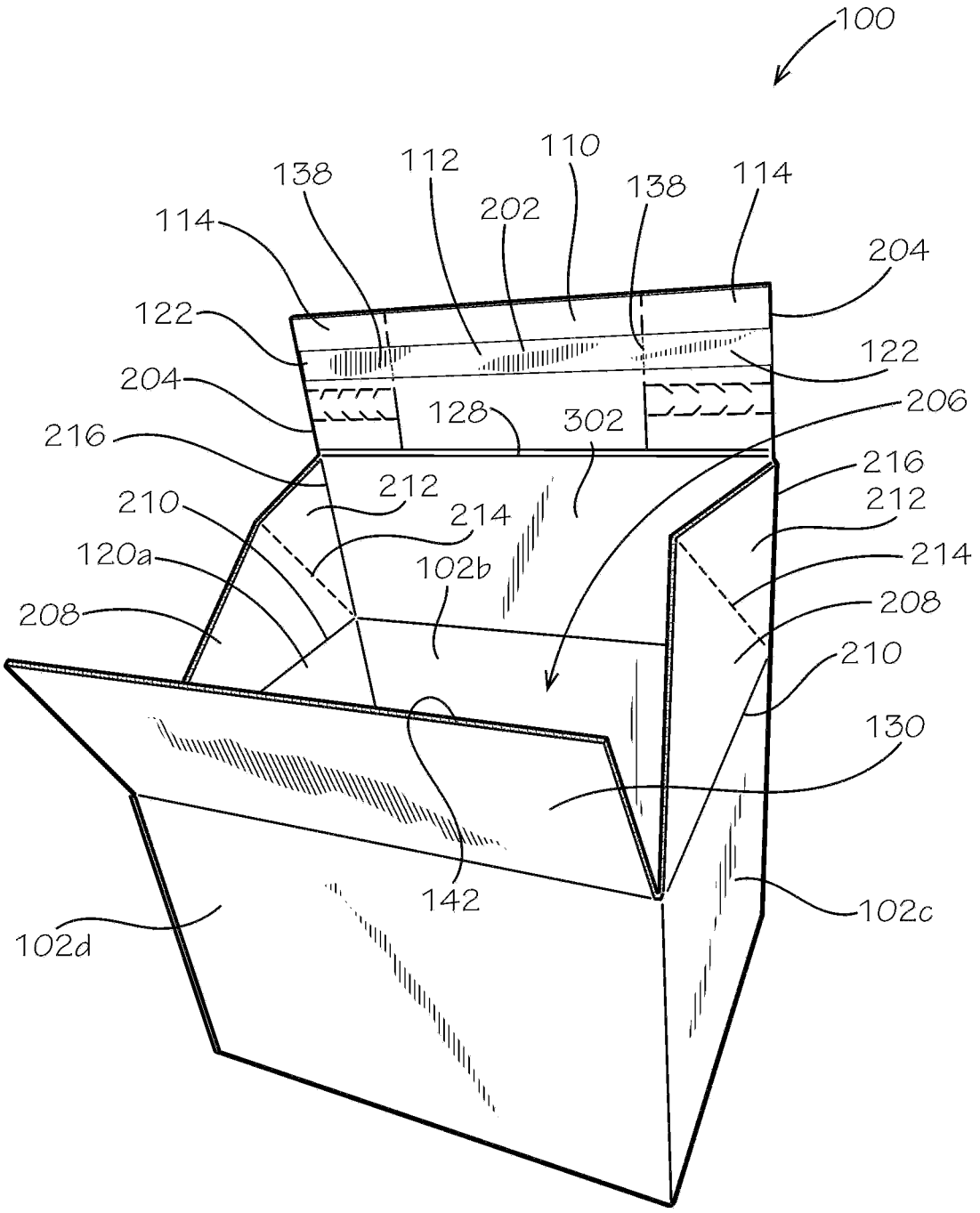
FIG. 2 is a perspective view of the box of FIG. 1A in an open configuration.

FIG. 2 is a perspective view of the box 100 in an open configuration. As shown, the primary sealing flap 110 can comprise a primary adhesive 112, and the secondary flap 114 can comprise a secondary adhesive 122. The primary adhesive 112 and the secondary adhesive 122 can each comprise a peelable backing 202. In some aspects, the adhesives 112,122 can be formed by first affixing a strip of double sided tape extending from an outside edge 204 of a first secondary flap 114, across the primary sealing flap 110, and to the outside edge 204 of a second secondary flap 114 opposite the first secondary flap 114. The flap cut 138 can then be made, sectioning the tape into segments on the primary sealing flap 110 and the secondary flap 114.

The box 100 can define an interior 206, as shown. The side panels 102 can comprise a pair of opposing front-rear side panels 102*b,d* and a pair opposing right-left side panels 102*a,c* extending between the front-rear side panels 102*b,d*. A pair of supporting subjacent panels 208 can each join to one of the right-left side panels 102*a,c* by a subjacent-side fold line 210. A supporting superjacent panel 212 can join to the supporting subjacent panel 208 by a superjacent-subjacent fold line 214 and can join to the connecting portion 132 by a connecting-superjacent fold line 216.

Figure 3:
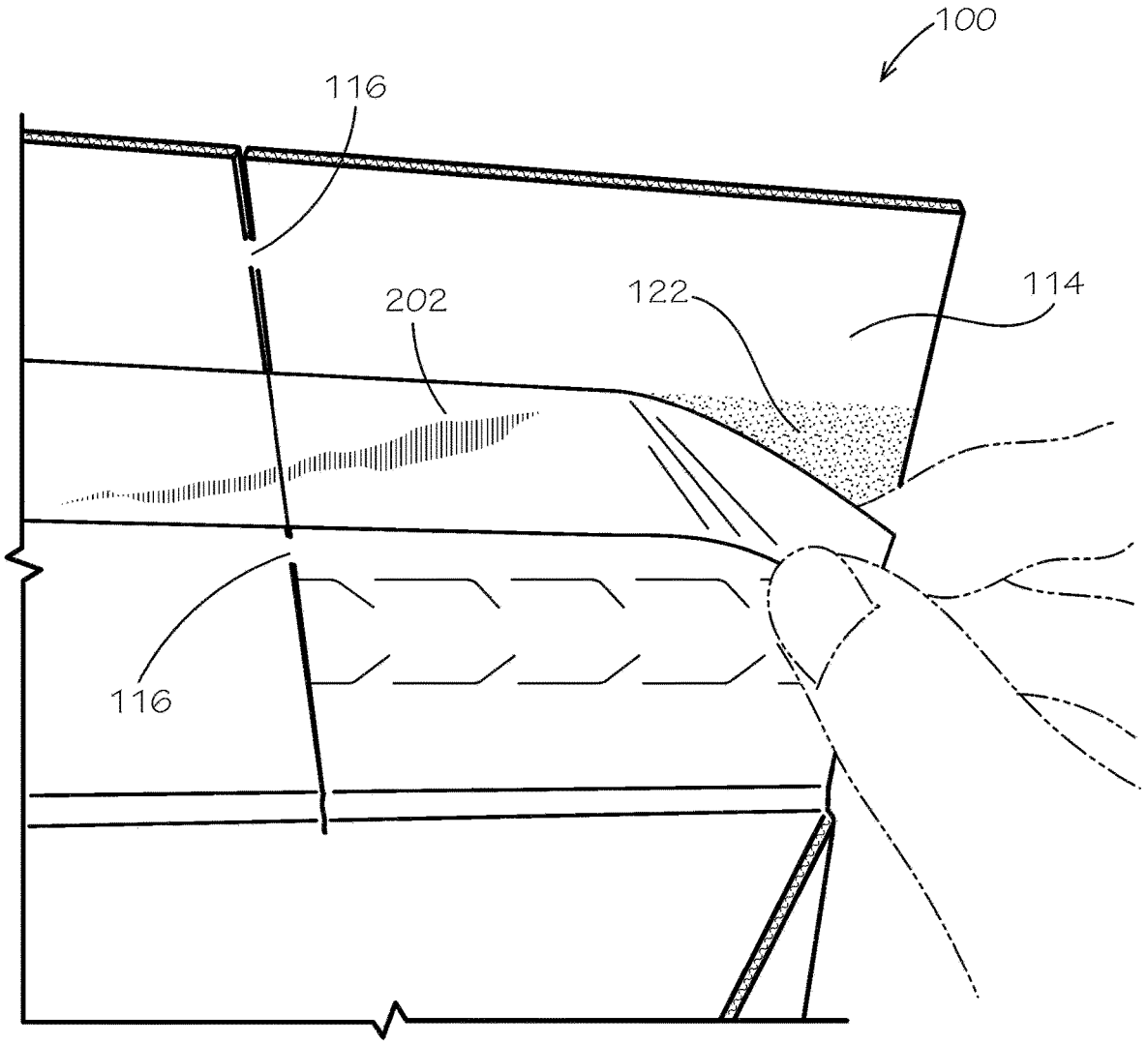
FIG. 3 is a detail view of the box of FIG. 1A, showing a right secondary flap.

FIG. 3 is a detail view of a right secondary flap 114. A method of sealing a top of the box 100 for the first time can begin with the step as shown. The peelable backing 202 of the secondary adhesive 122 can be removed to expose adhesive material beneath the peelable backing 202. In the aspect with two covering top side flaps 114, both covering top side flap adhesives 122 can be exposed. The perforated lines 116 can be seen more clearly in this view.

Figure 4A:
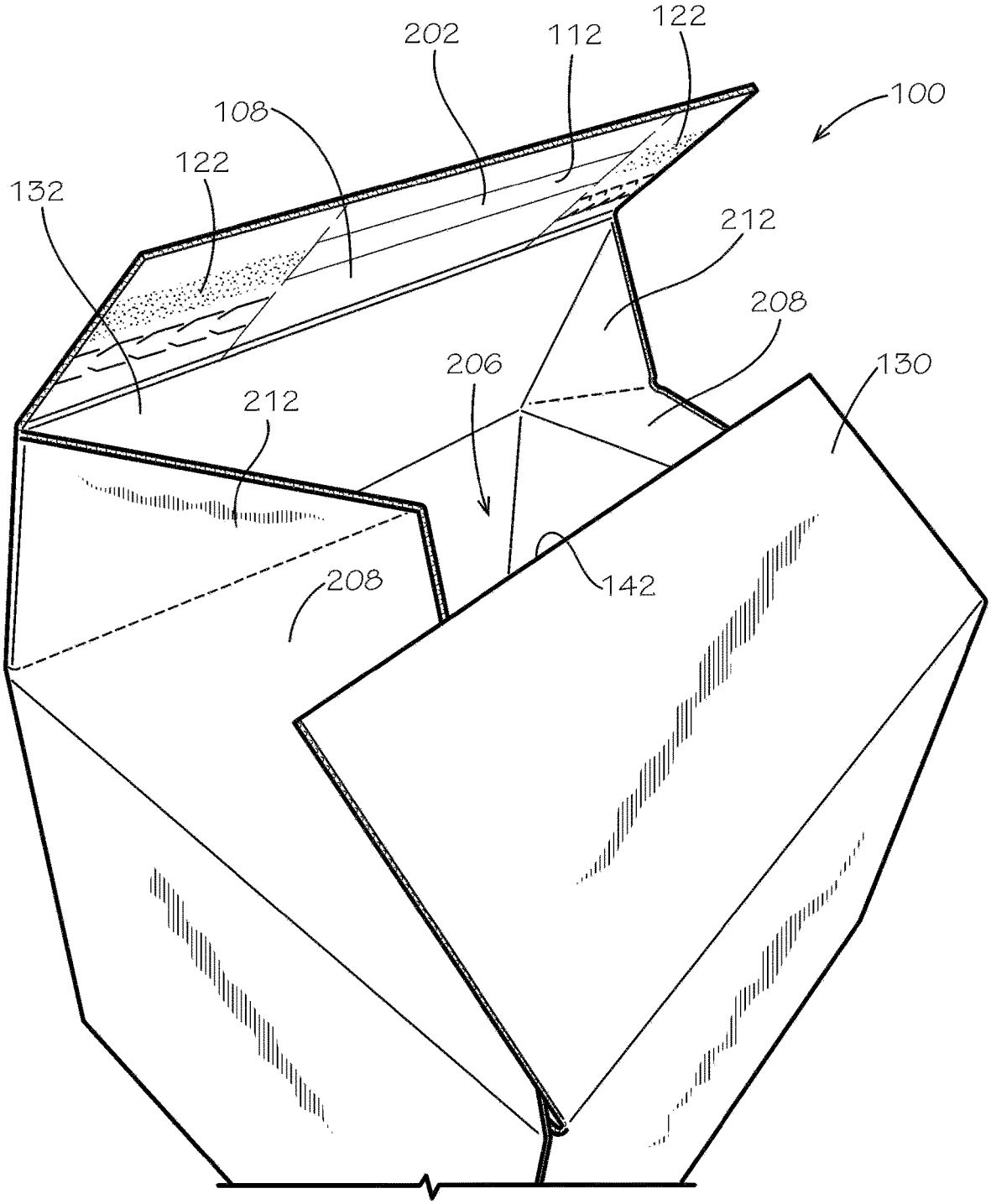
FIG. 4A is a perspective view of the box of FIG. 1A as it is being closed to the configuration of FIG. 1A.
Figure 4B:
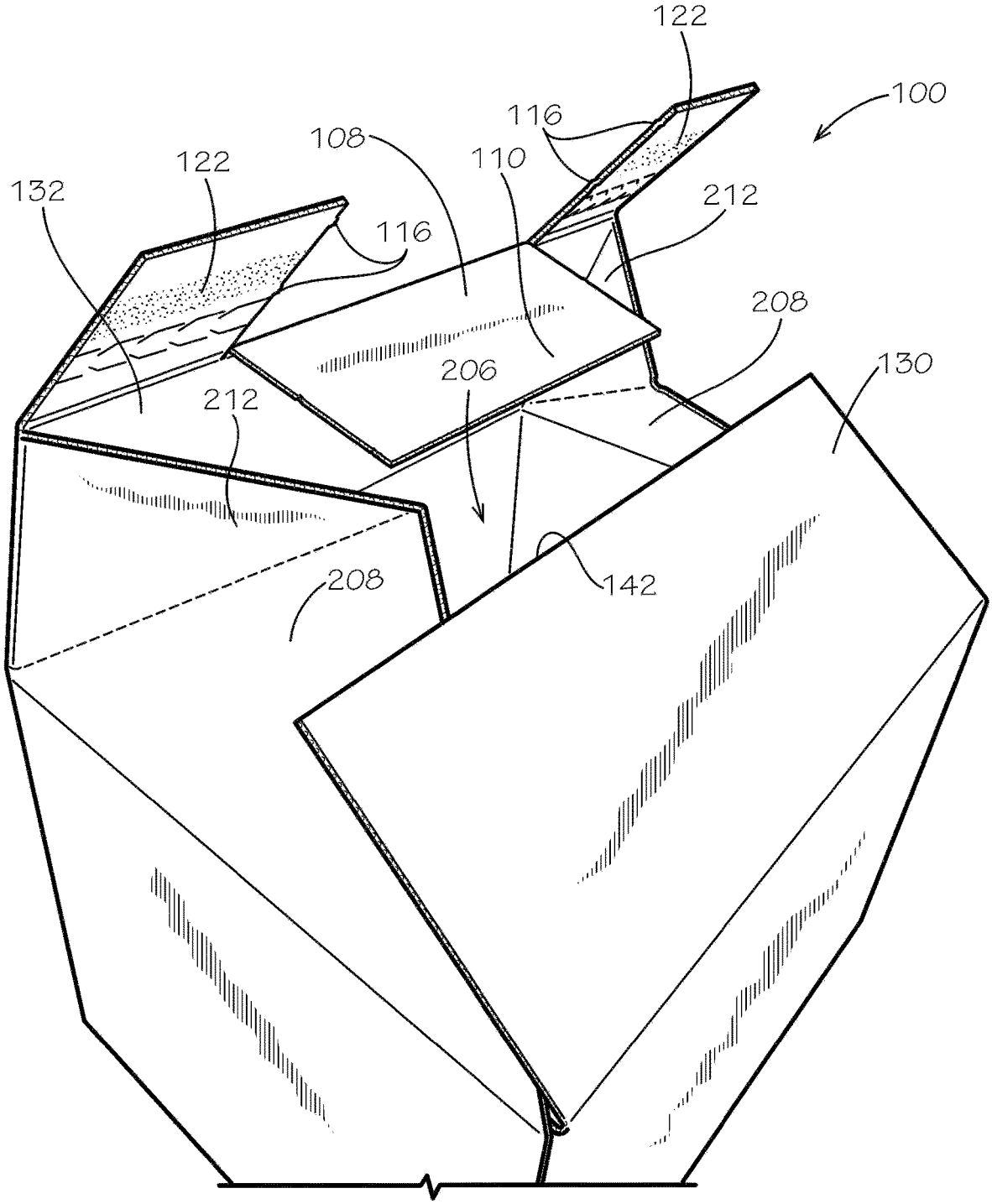
FIG. 4B is a perspective view of the box of FIG. 1A as it is being closed to the configuration of FIG. 1B.

FIG. 4A shows a next step in the method to seal the dual use box 100 the first time, in one aspect of the present disclosure. The peelable backing 202 on the covering top central flap adhesive 112 can be left on. The supporting subjacent and superjacent panels 208,212 can be pushed toward the box interior 206. The covered top panel 130 can be pushed toward the interior 206 over the supporting subjacent panels 208. In doing so, the connecting portion 132 (and therefore the overlapping portion 108) can concurrently be drawn down over the supporting panels 208,212 and the covered top panel 130, until the box 100 is sealed by engagement of the secondary adhesive 122 with the covered top panel 130 and the closed configuration shown in FIG. 1A is attained.

FIG. 4B shows the box 100 while it is being closed towards the configuration of FIG. 1B, in accordance with another aspect of the present disclosure. The primary sealing flap 110 can fold down, towards an underside (or interior face 302, shown in FIG. 9) of the covered top panel 130. This method of closing the box 100 can prevent the primary sealing flap 110 from becoming loose and accessible, as would be the case in FIG. 1A's configuration if the perforated lines 116 were torn or otherwise undone.

Figure 5:
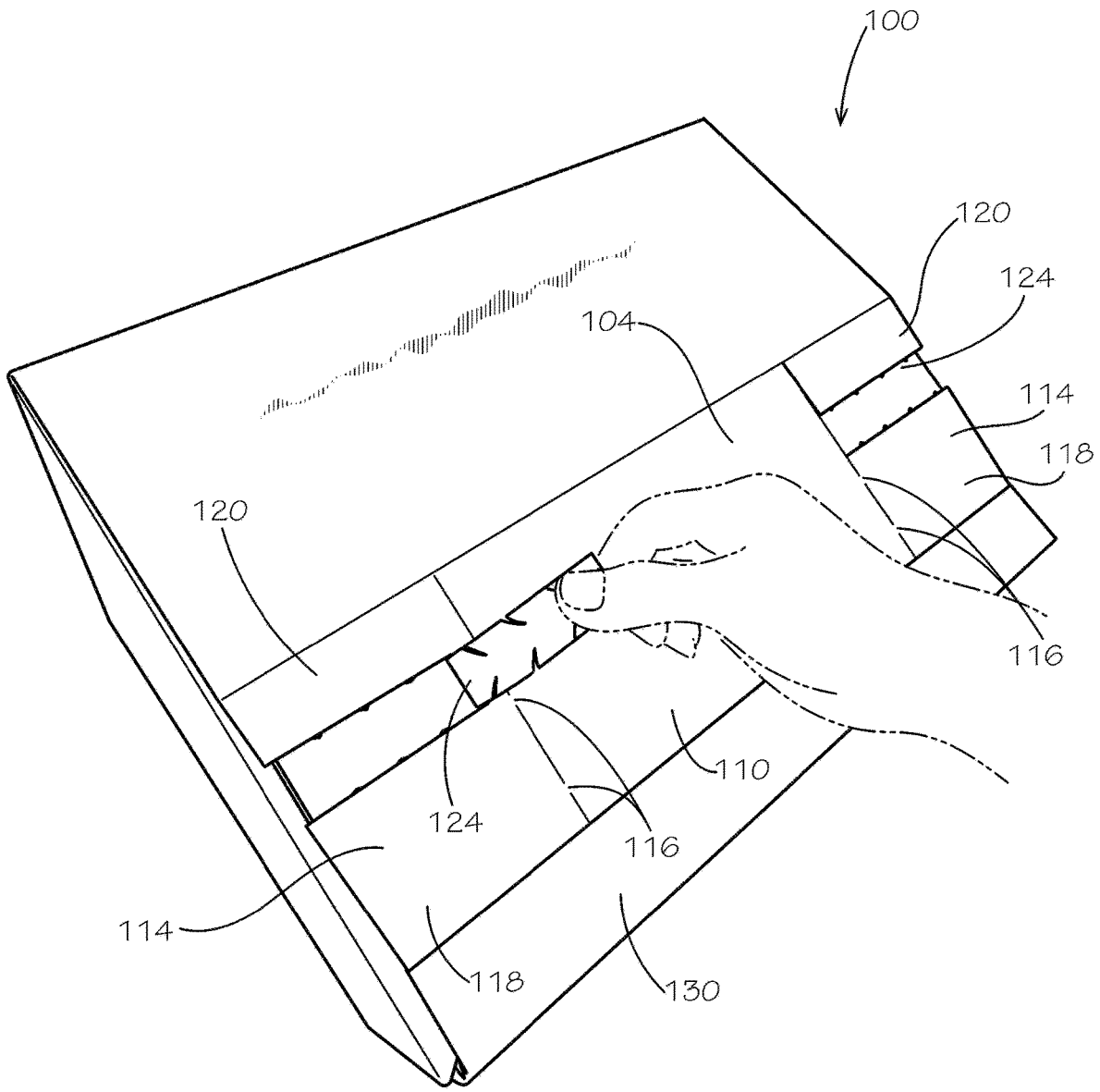
FIG. 5 is a perspective view of the box of FIG. 1A, showing a tear strip as it is torn.

FIG. 5 shows a step in opening the box 100 after the initial closure. In the aspect as shown aspect, a user—such as a customer receiving a product within the box 100—can pull at and undo each tear strip 124, separating the distal end 118 from the proximal portion 120. The tear strip 124 to the left is shown as already torn. A next step after undoing the tear strips 124 is to undo the perforated lines 116 holding the primary sealing flap 110 to the covering top side flaps 114. As such, the covering top panel 104, minus the distal ends 118 affixed to the covered top panel 130, can flip up, thereby opening the box, as shown in FIG. 6.

Figure 6:
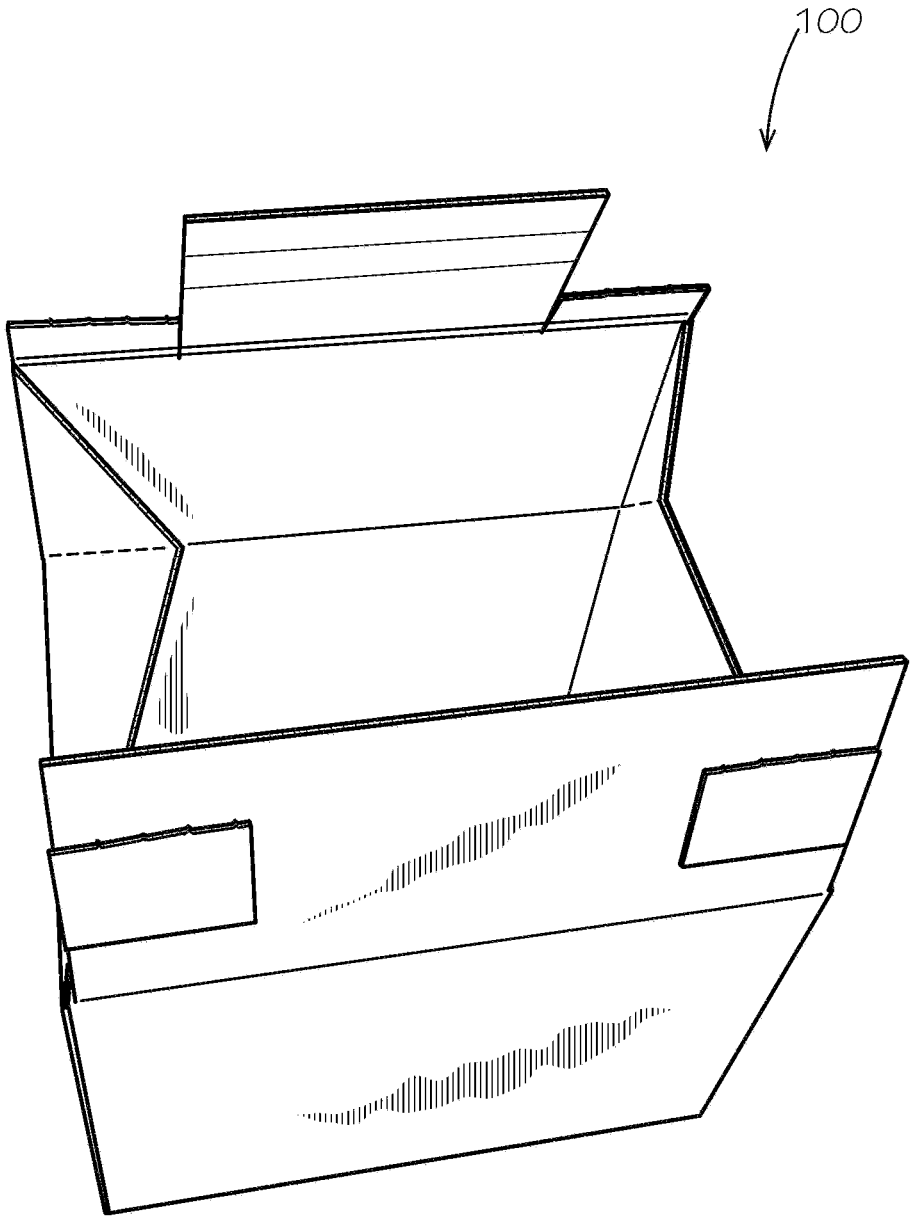
FIG. 6 is a perspective view of the box of FIG. 1A in an open configuration after it has been used once.

FIG. 6 is a perspective view of the box 100 after it has been opened after an initial use or closure.

Figure 7:
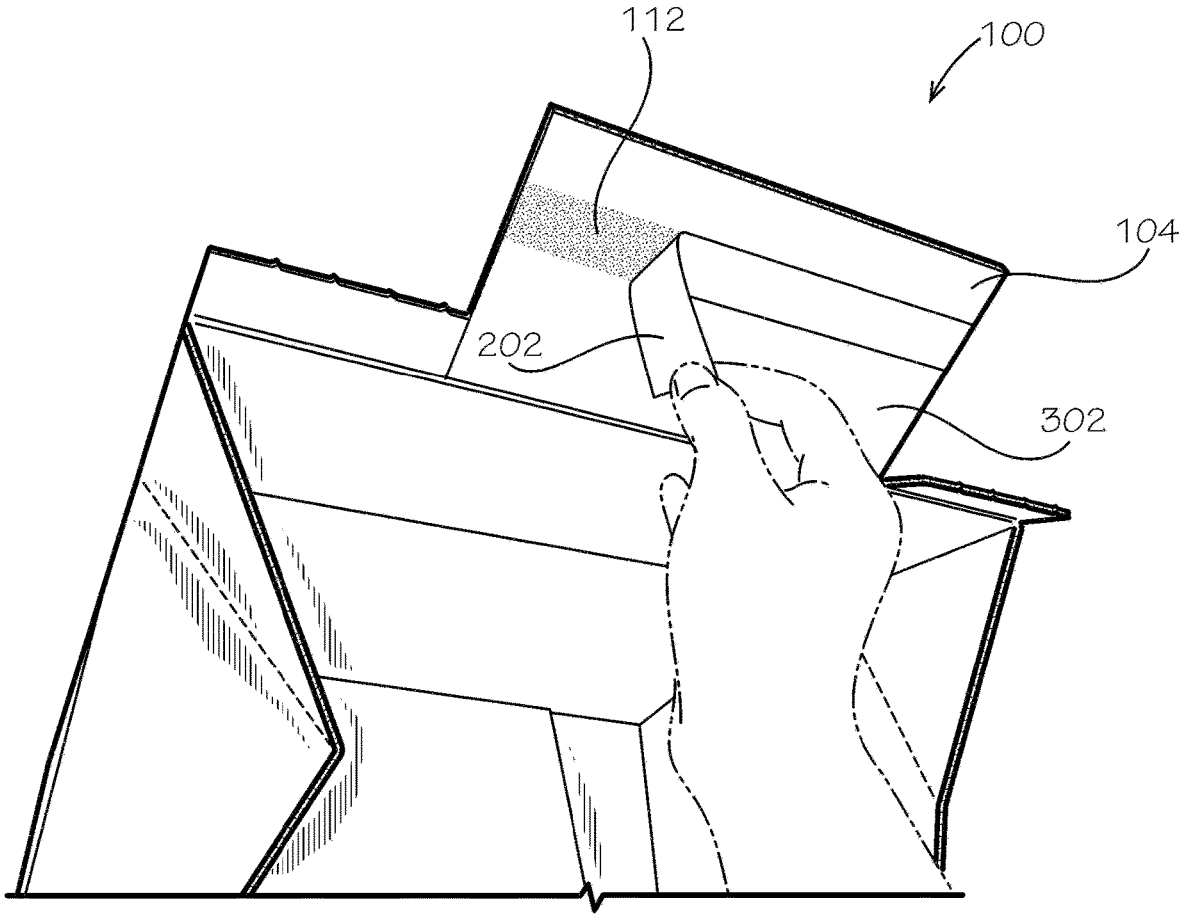
FIG. 7 is a perspective view of the box of FIG. 1A, showing a first step in sealing the box again after it has been opened once.

FIG. 7 is a perspective view of a first step in sealing the box 100 after it has been used once. The user can remove the peelable backing 202 from the covering top central flap adhesive 112. The user can then close the box in the same way as shown and described in FIG. 4A, except that the box 100 is held closed by the covering top central flap adhesive 112 engaging the covered top panel 130 instead of the covering top side flap adhesives 122 (hidden under the distal ends 118 in FIG. 8).

Figure 8:
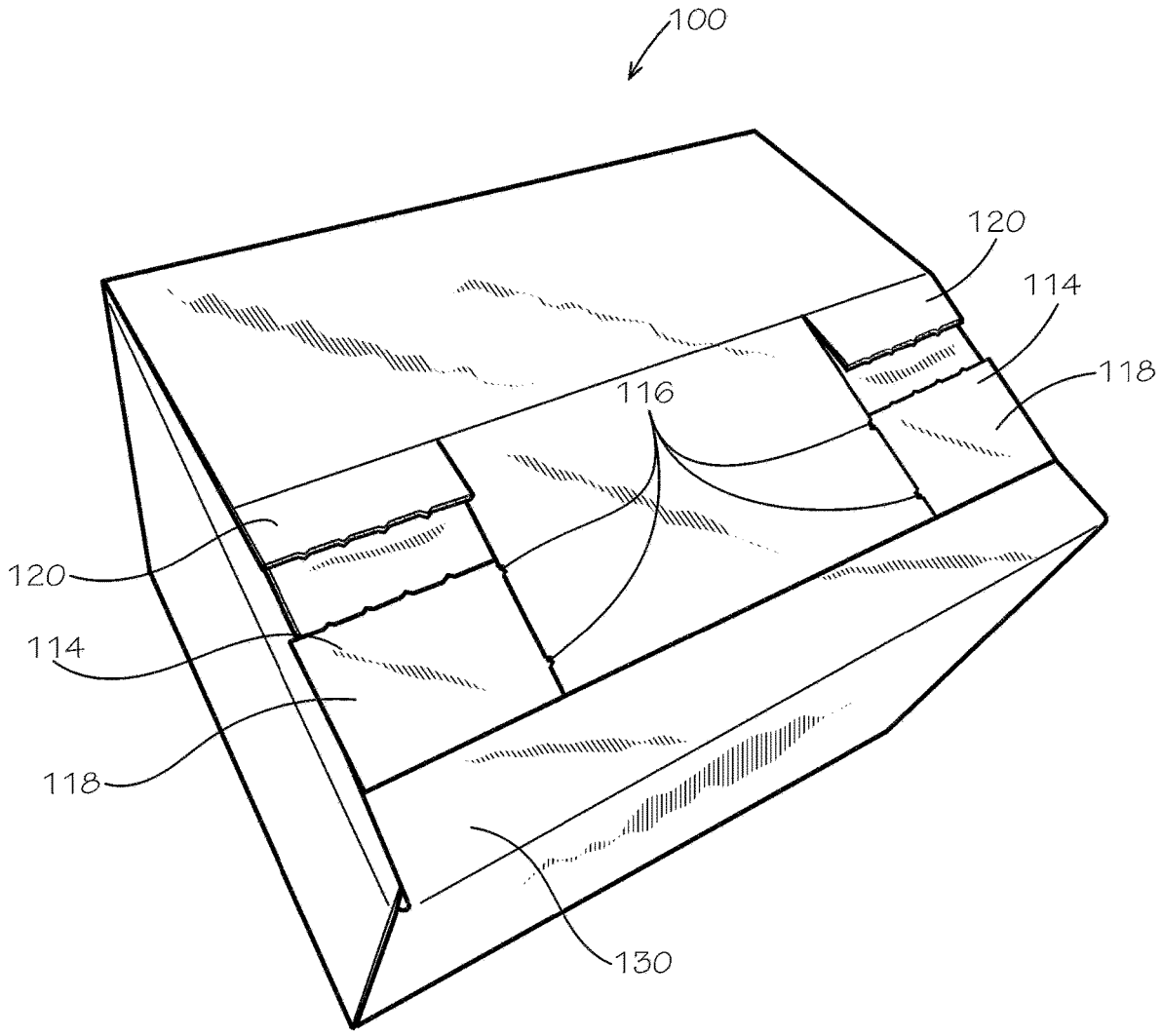
FIG. 8 is a perspective view of the dual use box of FIG. 1A after it is sealed a second time.

FIG. 8 is a perspective view of the dual use box 100 after it has been sealed a second time. One possible application for the dual use box 100 is for a customer to easily return an item in the same box 100 it arrived in. Several advantages are realized by the dual use box 100 as disclosed above. When the box 100 arrives to the customer, for example, the tear strips 124 can easily be seen, suggesting that they be torn, even without instructions. The perforated lines 116 are easily undone, such as by tearing. As shown in FIG. 7, when the interior face 302 of the covering top panel 104 is revealed, only the peelable backing 202 on the covering top central flap adhesive 112 is remaining, suggesting that it should be removed to allow for a second sealing. In other aspects, the proximal portions 120 of the covering top second flaps (covering top side flaps) 114 can tuck under the covered top panel 130, reducing the number of loose ends on the box 100 and creating a cleaner look. Instructions for opening the box 100 and resealing it can be printed on the box 100 itself, for example and without limitation.

As such, a customer can easily open and reseal the box 100, even without written instructions, or with only minimal instructions written on the box 100, for example. The initial sealing may be done by a warehouse, packaging, or factory worker.

FIG. 9 is a plan view of the blank 3 for the dual use box 100. The various portions of the box that have been previously introduced can be seen in this configuration: the side panels 102*a,b,c,d*; the primary adhesive 112; the secondary adhesives 122; the covered top panel 130; the supporting subjacent panels 208; the supporting superjacent panels 212; and the interior face 302. The side panels 102*a-d* can be divided by side-side fold lines 950.

The box 100, and therefore, the blank 3 of the box 100, can further comprise a side panel glue tab 902 configured to join the fourth side panel 102*d* to the first side panel 102*a* by an adhesive such as hot melt, tape, glue, or any other method of affixing surfaces known in the art.

The box 100 can further comprise bottom panels 904, such as a first, second, third, and fourth bottom panel 904*a,b,c,d*, each connected to a corresponding first to fourth side panel 102*a-d* by a corresponding first, second, third, or fourth side-bottom fold line 914*a-d*. The second and third bottom panels 904*b,c* can comprise a glue area 906,908 configured to affix to an adjacent bottom panel 904. The glue areas 906,908 can be bordered on an interior boundary by a collapsing fold line 910,912 configured to fold as the box is put into a folded-down configuration (shown in FIGS. 10 and 11). The collapsing fold lines 910,912 can be angled approximately 45-degrees from the side-bottom fold lines 914*b,c*. The second and third bottom panels 904*b,c* can further define a notch 922*a,b* at a corner where the collapsing fold lines 910,912 meet the side-bottom fold lines 914*b,c*.

Each of the bottom panels 904*a-d* can be an approximate tetragon (four-sided polygon) bordered at one edge by one of the side-bottom fold lines 914*a-d* and on the other three sides by left and right side edges and an extending edge. For example, the edges designated as 916, 924, 934, and 942 can be regarded as left side edges of each of the four bottom panels 904*a-d*. The edges designated as 920, 932, 948, and 946 can be right side edges of the bottom panels 904*a-d*.

The first bottom panel 904*a* can comprise an extending edge 918. The extending edge of the second bottom panel 904*b* can comprise the segments 926, 928, and 930. The extending edge of the third bottom panel 904*c* can comprise segments 936, 938, and 940. And the extending edge of the fourth bottom panel 904*d* can comprise the segment 944.

Figure 10:
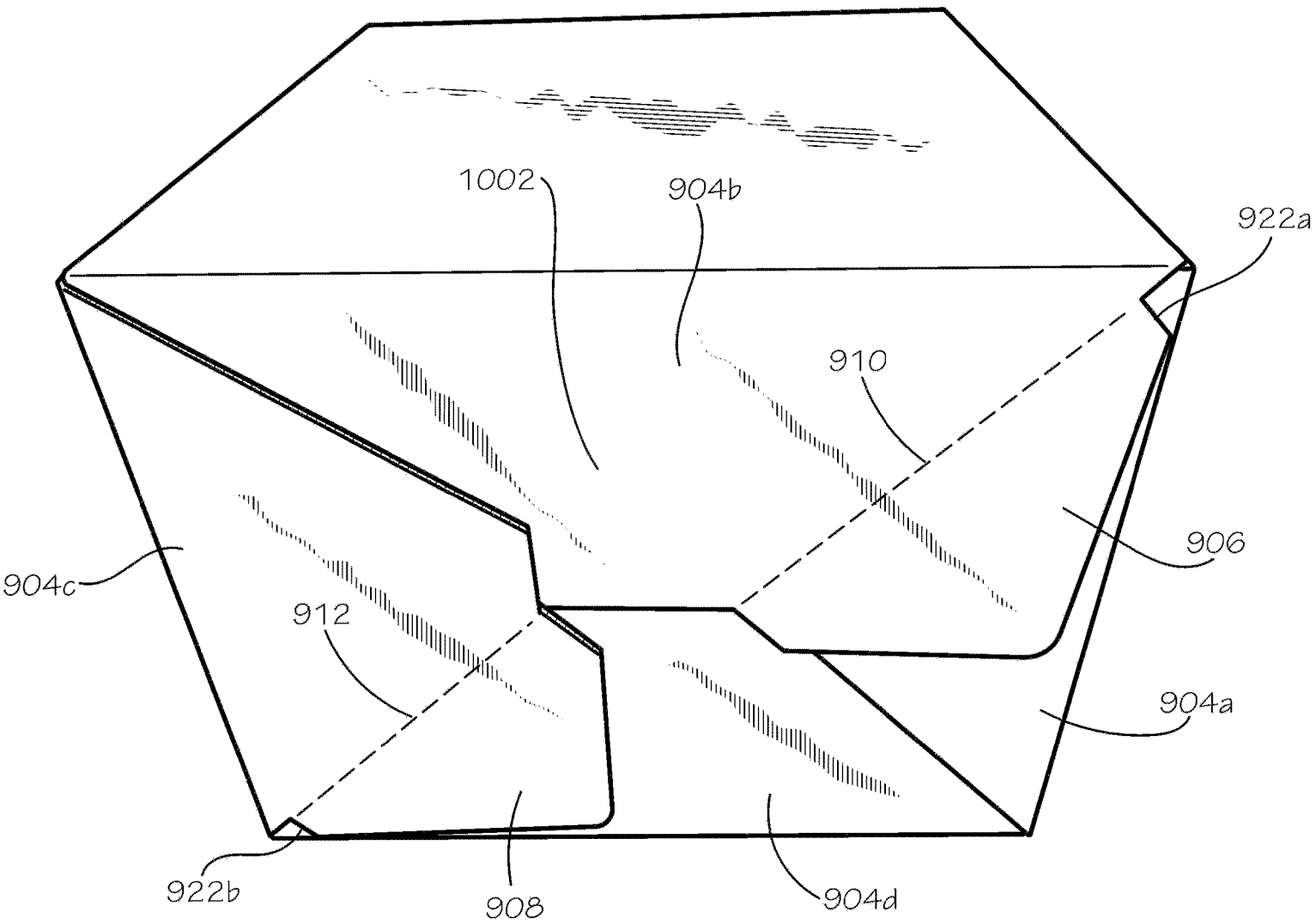
FIG. 10 is a perspective view of a bottom of the box of FIG. 1A.
Figure 12:
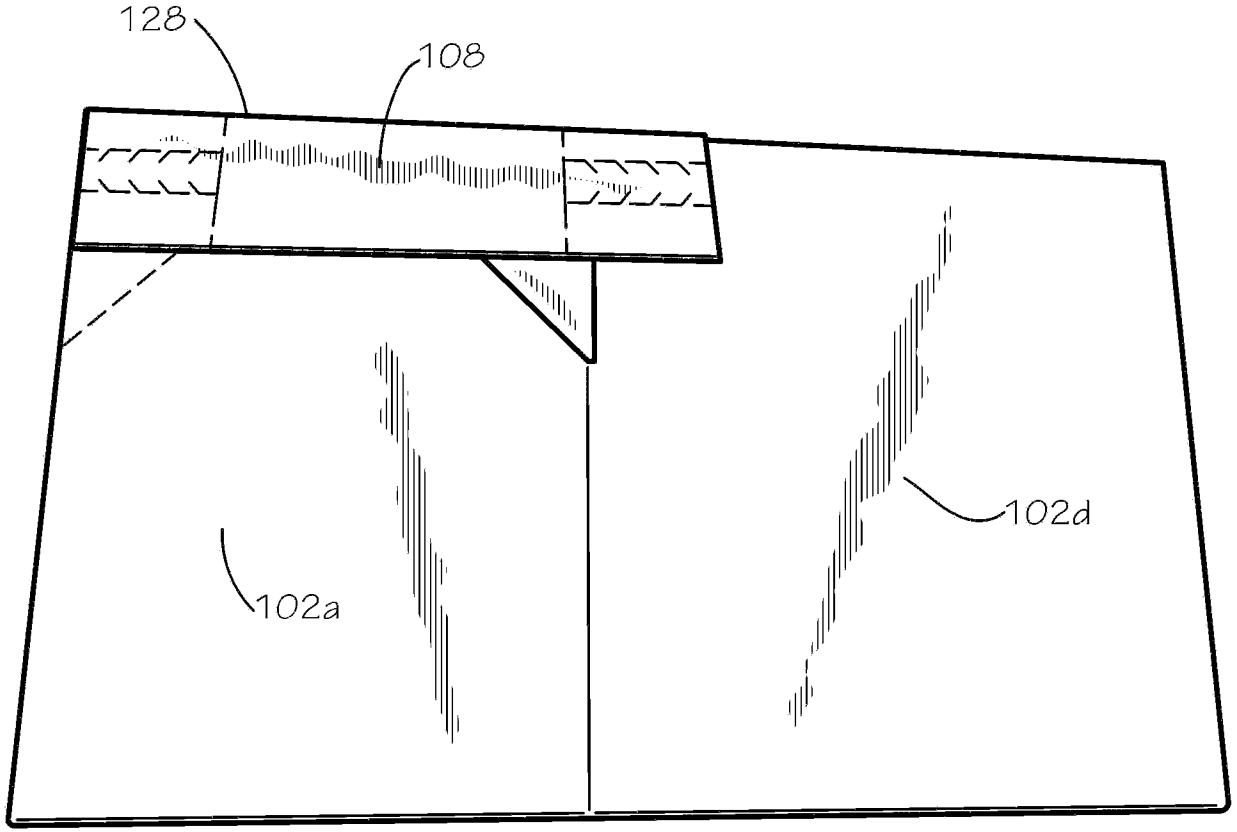
FIG. 12 is a perspective view of the box of FIG. 1A in a completely collapsed configuration.

The bottom panels can be shaped as described to allow the box 100 to collapse (as shown in FIG. 12) and stand back up (as shown in FIGS. 1, 4, and 10, for example) by a simple pushing-in or pushing-out of the box bottom 1002 (shown in FIG. 10), respectively. As such, the bottom 1002 can also be called an auto bottom 1002. The fourth bottom panel 904*d* can be sized such that it substantially covers the box bottom 1002 in the standing configuration (not shown). For example, the extending edge 944 can be adjacent the second side-bottom fold line 914*b*, and the right side edge 946 can be adjacent the first side-bottom fold line 914*a* in the standing configuration. The left side edge 942 can form an acute angle with the fourth side-bottom fold line 914*d*, such that a person can grab that edge from inside the box while it is standing, facilitating the box 100 to collapse. Except for an area bounded by the left side edge 942, the fourth bottom panel 904*d* about fully covers the box bottom 1002, preventing people from reaching inside the box from the outside through the bottom 1002. As such, the fourth bottom panel 904*d* can be called a security panel 904*d*.

FIG. 10 is a perspective view of the bottom 1002 of the box 100. The following portions of the box 100 are labelled: the first through fourth bottom panels 904*a-d*; the glue areas 906,908 of the second and third bottom panels 904*b,c*; the collapsing fold lines 910,912 of the second and third bottom panels 904*b,c*; and the notches 922*a,b* of the second and third bottom panels 904*b,c*. As shown, the glue area 906 of the second bottom panel 904*b* can attach to the first bottom panel 904*a*, and the glue area 908 of the third bottom panel 904*c* can attach to the fourth bottom panel 904*d*.

Figure 11:
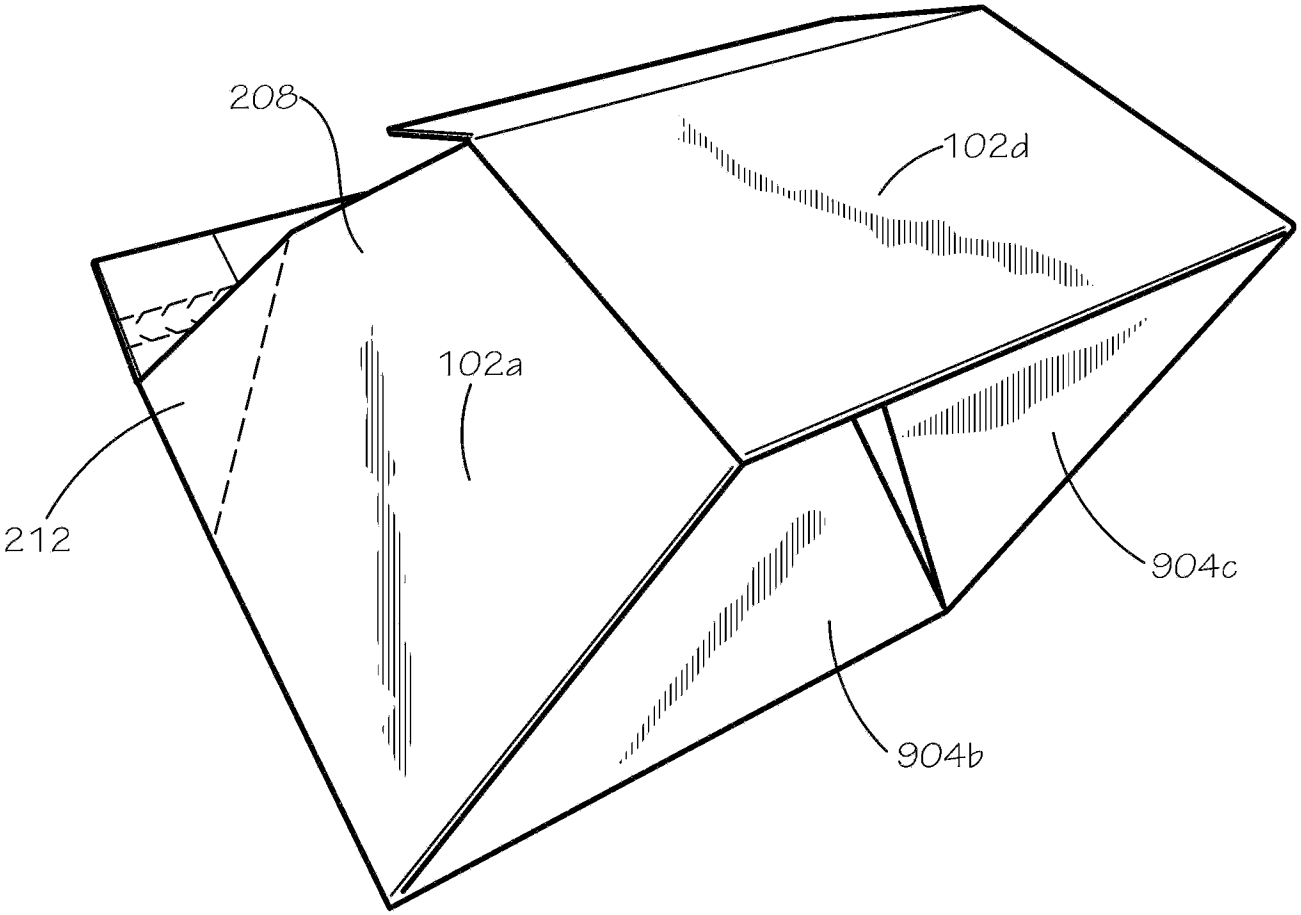
FIG. 11 is a perspective view of the box of FIG. 1A in a partially collapsed configuration.

FIG. 11 is a perspective view of the box 100 in a partially folded-down configuration. Shown are the first and the fourth side panels 102*a,d*; the supporting subjacent and superjacent panels 208,212, and the second and third bottom panels 904*b,c*.

FIG. 12 is a perspective view of the box 100 in the folded-down configuration. The box 100 can be shipped and stored in this configuration, prior to first use. As shown, the overlapping portion 108 can fold over the first side panel 102*a* and a portion of the fourth side panel 102*d*. The double fold line at the connecting-over fold line 128 can aid in folding the overlapping portion 108 in this way. The box 100 in this collapsed configuration defines a rectangular outline, allowing for easier shipping, stacking, and storage.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A method of opening a box comprising:

providing the box in a closed configuration, the box comprising a first top panel attached to a second top panel, the first top panel comprising a first sealing flap, a second sealing flap, and a middle flap disposed therebetween;

removing a first tear strip of the first sealing flap to detach the first sealing flap from the second top panel; and removing a second tear strip of the second sealing flap to detach the second sealing flap from the second top panel and to configure the box in an open configuration.

2. The method of claim 1, wherein:

the first top panel defines a first side edge and a second side edge opposite the first side edge;

the first tear strip extends from the first side edge to the middle flap; and the second tear strip extends from the second side edge to the middle flap.

3. The method of claim 2, wherein the first tear strip is substantially colinear with the second tear strip.

4. The method of claim 2, wherein:

the first top panel defines a free distal edge extending from the first side edge to the second side edge; and each of the first sealing flap, the second sealing flap, and the middle flap are disposed at the free distal edge of the first top panel.

5. The method of claim 4, wherein each of the first tear strip and the second tear strip are parallel to the free distal edge of the first top panel.

6. The method of claim 4, wherein:

the first sealing flap comprises a first adhesive applied to a distal end of the first sealing flap;

the second sealing flap comprises a second adhesive applied to a distal end of the second sealing flap;

the distal end of the first sealing flap is defined between the free distal edge and the first tear strip and the distal end of the second sealing flap is defined between the free distal edge and the second tear strip; and each of the first adhesive and the second adhesive are adhered to the second top panel.

7. The method of claim 6, wherein each of the distal end of the first sealing flap and the distal end of the second sealing flap remains adhered to the second top panel in the open configuration.

8. The method of claim 6, wherein the middle flap comprises a third adhesive applied thereto, the third adhesive configured to seal the box in a second closed configuration.

9. The method of claim 8, wherein the first adhesive, the second adhesive, and the third adhesive are formed as a singular adhesive strip extending from the first side edge of the first top panel to the second side edge of the first top panel.

10. The method of claim 4, wherein a portion of the second top panel extending between the free distal edge of the first top panel and a proximal edge of the second top panel is uncovered by the first top panel.

11. The method of claim 1, wherein:

the box defines an interior cavity;

the second top panel defines an inner surface facing the interior cavity in the closed configuration and an outer surface facing away from the interior cavity in the closed configuration; and each of the first sealing flap and the second sealing flap are attached to the outer surface of the second top panel in the closed configuration.

12. The method of claim 11, wherein the middle flap is connected to the first sealing flap by a first perforated line and connected to the second sealing flap by a second perforated line.

13. The method of claim 12, wherein the first top panel further comprises a connecting portion, and wherein the middle flap is hingedly connected to the connecting portion by a connecting fold line.

14. The method of claim 13, wherein, in the closed configuration, the middle flap is folded relative to the connecting portion and is tucked under the second top panel to dispose the middle flap within the interior cavity of the box.

15. The method of claim 1, wherein the box further comprises a first side panel, a second side panel opposite the first side panel, a third side panel, and a fourth side panel opposite the third side panel, the first top panel is hingedly connected the first side panel, and the second top panel is hingedly connected to the second side panel.

16. The method of claim 15, wherein:

the box defines an interior cavity and an opening allowing access to the interior cavity;

the first top panel and the second top panel cover the opening in the closed configuration; and the method further comprises folding each of the first top panel and the second to panel outward and away from the interior cavity after removing the first tear strip and the second tear strip.

17. The method of claim 16, wherein:

a supporting subjacent panel is pivotably connected to the third side panel at a first fold line;

a supporting superjacent panel is pivotably connected to the first top panel at a second fold line;

the supporting subjacent panel is pivotably connected to the supporting superjacent panel at a third fold line; and folding the first top panel outward and away from the interior cavity further comprises unfolding the supporting subjacent panel relative to the third side panel at the first fold line, unfolding the supporting superjacent panel relative to the first top panel at the second fold line, and unfolding the supporting subjacent panel relative to the supporting superjacent panel at the third fold line.

18. The method of claim 17, wherein:

the first top panel further comprises an overlapping portion and a connecting portion extending between the first side panel of the box and the overlapping portion;

the overlapping portion includes the first sealing flap, the second sealing flap, and the middle flap; and the supporting superjacent panel is pivotably connected to the connecting portion of the first top panel at the second fold line.

* * * * *